US005603441A

United States Patent [19]

Easter

[11] Patent Number: 5,603,441

[45] Date of Patent: Feb. 18, 1997

[54] MULTI-PURPOSE FRONT/BACK PACK APPARATUS

[76] Inventor: Michael D. Easter, 840 J St., Penrose, Colo. 81240

[21] Appl. No.: 328,156

[22] Filed: Oct. 24, 1994

[51] Int. Cl.[6] ..... A45F 4/02

[52] U.S. Cl. ..... 224/582; 224/153; 224/160; 224/646; 224/647; 224/648; 224/652; 224/268

[58] Field of Search ..... 224/153, 158–161, 224/209, 214, 215, 216, 227, 264, 282, 581, 582, 627, 637, 645, 646, 647, 648, 650, 651, 652, 653, 654, 268; 190/103, 110, 104, 105

[56] References Cited

U.S. PATENT DOCUMENTS

| | | | |
|---|---|---|---|
| 2,461,526 | 2/1949 | Cull et al. | 224/209 |
| 2,813,602 | 11/1957 | MacArthur, Jr. | 190/110 |
| 4,057,181 | 11/1977 | Finnigan | 224/282 |
| 4,491,258 | 1/1985 | Jones | 224/153 |
| 4,805,749 | 2/1989 | Gerch | 190/103 |
| 5,178,309 | 1/1993 | Bicheler et al. | 224/153 |

FOREIGN PATENT DOCUMENTS

| | | | |
|---|---|---|---|
| 605327 | 9/1960 | Canada | 224/153 |
| 1101785 | 10/1955 | France | 190/103 |
| 1308040 | 9/1962 | France | 224/209 |
| 1557297 | 2/1969 | France | 190/103 |
| 2387002 | 12/1978 | France | 224/209 |
| 2577771 | 8/1986 | France | 190/110 |
| 3033237 | 4/1982 | Germany | 224/209 |
| 11757 | 7/1924 | Netherlands | 224/209 |
| 129795 | of 1912 | United Kingdom | 224/209 |
| 518028 | 2/1940 | United Kingdom | 224/209 |

*Primary Examiner*—Henry J. Recla
*Assistant Examiner*—Gregory M. Vidovich
*Attorney, Agent, or Firm*—Phillip A. Rein

[57] ABSTRACT

A multi-purpose front/back pack apparatus having the primary elements of 1) a front pack assembly; 2) a pack and gun carrier frame; 3) a gun and cartridge carrier assembly mounted on the pack and gun carrier frame; 4) a shoulder strap assembly connected to the front pack assembly and the pack and gun carrier frame; 5) a back pack assembly; and 6) a support belt member operable to interconnect the back pack assembly to the front pack assembly. The front pack assembly is provided with an expandable main pack bag and can be utilized with a gun and cartridge carrier assembly for conveyance of a gun member. Other features are 1) the back pack assembly is releasably connected to the support belt member; 2) that pivotal and foldable twin pocket members are provided to convey items and can be pivoted from an enclosed folded position to an outward expanded position for maximum capacity of the back pack assembly; and 3) a baby carrier assembly may be releasably connected to the shoulder strap assembly for supporting an infant between the person using the invention and the front pack assembly.

22 Claims, 12 Drawing Sheets

MULTI-PURPOSE FRONT/BACK PACK APPARATUS

PRIOR ART

A patent search was conducted on this invention and revealed the following United States patents:

| U.S. Pat. No. | Inventor |
|---|---|
| 3,233,803 | Gray |
| 3,733,017 | Pletz |
| 4,307,826 | Stewart |
| 4,431,122 | Garmong |
| 5,067,643 | McKinney |
| 5,184,763 | Blaisdell et al |

The Gray patent discloses a combined take-down pack board and expandable pack sack having straps thereon and a framework for packing.

The Pletz patent discloses an adjustable pack frame having means for conveyance on one shoulder and is utilized in combination with a connector waist belt.

The Stewart patent discloses a hip supported back pack having means for quick disconnection to release the backpack from the user thereof.

The Garmong patent discloses a gun support utilized with a multi-purpose sling for supporting an elongated hand-held fire arm but is dissimilar in many aspects to the applicant's invention.

The McKinney patent discloses a hip level pack frame utilized with a belt to be secured to a waist and having bags supported at the wearer's waist and in combination with a shoulder strap.

The Blaisdell et al patent discloses a modular free movement backpack system having upper and lower modulars and combining with shoulder straps and a waist belt to provide support added thereto.

PREFERRED EMBODIMENT OF THE INVENTION

In one preferred embodiment of this invention, a multi-purpose front/back pack apparatus is provided having 1) a first embodiment being a front and back pack with gun carrier assembly; 2) a second embodiment being a front and back pack with foldable twin pockets; 3) a third embodiment being a front back pack with foldable twin pockets; and 4) a fourth embodiment being a front and back pack with foldable twin pockets and baby carrier.

The front and back pack with gun carrier assembly includes 1) a front pack assembly; 2) a pack and gun carrier frame having a gun and cartridge carrier assembly mounted thereon; 3) a shoulder strap assembly connected to the front pack assembly for support on a person utilizing same; 4) a back pack assembly; and 5) a support belt member connecting the back pack assembly to the front pack assembly.

The front pack assembly includes 1) an expandable main pack bag; 2) bottle carrier members connected to the expandable main pack bag; and 3) a frame connector assembly connected to the expandable main pack bag. The pack and gun carrier frame is connected to the frame connector assembly.

The expandable main pack bag is provided with a foldable pack housing having a map storage container connected thereto.

The foldable pack housing provides a storage area and can be open from an enclosed position to an expanded position to increase the storage capacity thereof.

The map storage container is provided with a map pocket member to receive and enclose a map therein or other similar article and selectively enclosed by a retaining flap member.

The bottle carrier members provide open pockets secured to opposite sides of of the expandable main pack bag to receive and support water bottles and the like therein.

The pack and gun carrier frame is of generally U-shape having J-support sections on outer ends thereof operable to support the expandable main pack bag at an upper end thereof and the gun and cartridge carrier assembly on a lower end thereof.

The gun and cartridge carrier assembly includes a cartridge carrier assembly to receive, support, and enclose cartridges therein, belt connector loops to receive the support belt member therein, and frame cover sleeves to receive and support an elongated gun member thereon.

The shoulder strap assembly includes upper and lower shoulder strap assemblies operable to be connected to the front pack and gun carrier assembly for support about the shoulder areas of the person utilizing this invention.

The back pack assembly includes a back pack bag connected to a back pack support frame and cover, belt connector members to receive the support belt member therein, and side container pockets to receive, support, and contain articles therein.

The back pack bag includes a main back pack housing to receive articles to be conveyed therein and being enclosed by a back pack closure member.

The back pack support frame and cover includes a rigid support frame member having a support cover member mounted thereon to enclose articles contained within the back pack bag.

The support belt member is of a conventional nature adapted to be trained through the belt connector members of the back pack assembly and the belt connector loops of the gun and cartridge carrier assembly when worn about a waist area of the person utilizing this invention.

In the second embodiment, as noted in FIG. 10, the front and back pack with foldable twin pockets includes the previously noted 1) front pack assembly; 2) shoulder strap assembly connected to the front pack assembly; and 3) a back pack assembly interconnected by a support belt member to the front pack assembly; and further includes foldable twin pocket members connected to the front pack assembly.

Each foldable twin pocket member includes a pocket housing having an enclosure cap member mounted thereon and a releasable connector assembly to secure the pocket housing in a collapsed or an extended position.

The foldable twin pocket members are operable to support, conceal, and enclose articles therein and are operable to be utilized in an expanded position as shown in FIG. 10 with the front pack assembly to be folded inwardly to an enclosed or collapsed position as noted in FIG. 11.

The third embodiment, as shown in FIG. 11, is the front back pack with foldable twin pockets which is substantially identical to the second embodiment without utilizing the back pack assembly.

The fourth embodiment, as shown in FIG. 15, is the front and back pack with foldable twin pockets and baby carrier having the previously described front pack assembly, shoulder strap assembly, back pack assembly, support belt member, and further includes a baby carrier assembly.

The baby carrier assembly includes a main support member having a crotch support member connected thereto and provided with connector members for attachment to the shoulder strap assembly and pack connector straps for connecting to the front pack assembly.

The baby carrier assembly is easily foldable to a non-use position but can be opened to the usage position and placed against a back side of the front pack assembly being connected thereto to provide a secure infant carrier structure which is comfortable to both the person utilizing same and an infant being carried thereon.

OBJECTS OF THE INVENTION

One object of this invention is to provide a multi-purpose front/back pack apparatus including 1) a front and back pack with gun carrier assembly to achieve support of numerous articles therein and providing means of supporting and carrying an elongated gun member for hunting purposes; and 2) a front and back pack with foldable twin pockets with baby carrier which can be readily utilized to support and carry an infant thereon with a minimum amount of effort and maximum comfort to the person conveying an infant thereon.

One other object of this invention is to provide 1) a front and back pack with gun carrier assembly having a front pack assembly connected to a shoulder strap assembly mounted on the person utilizing same: 2) a back pack assembly to be carried on a rear hip area of the person utilizing same; and 3) a support belt member used in combination with the shoulder strap assembly which interconnects the back pack assembly, the front pack assembly, and a gun and cartridge carrier assembly to provide a compact, rigidly supported assembly for the comfort of the person utilizing same.

Another object of this invention is to provide a front and back pack with foldable twin pockets including 1) a front pack assembly 2) a shoulder strap assembly connected to the front pack assembly; 3) a back pack assembly; 4) a support belt member interconnected to the front pack assembly and the back pack assembly; and 5) foldable twin pocket members to provide additional storage and conveyance areas for articles therein.

A further object of this invention is to provide a front back pack with foldable twin pockets including a front pack assembly connected to a shoulder strap assembly and a support belt member plus having foldable twin pocket members to receive and contain articles therein with the twin pocket members being utilized either in a folded collapsed position or in an outward expanded position when the front pack assembly is opened to a maximum capacity position.

Another object of this invention is to provide a front and back pack with foldable twin pockets and baby carrier which is utilized with foldable twin pockets in the collapsed or expanded positions plus having a baby carrier assembly which can be mounted between the front pack assembly and the person utilizing same to provide a compact, safe position for conveying an infant thereon while achieving maximum comfort to the person utilizing same.

Still, one other object of this invention is to provide a multi-purpose front/back pack apparatus which is economical to manufacture; easy to be mounted and secured on the person utilizing same; providing numerous support areas, such as through a shoulder strap assembly and a support belt member; achieving maximum comfort to a person utilizing same; sturdy in construction; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
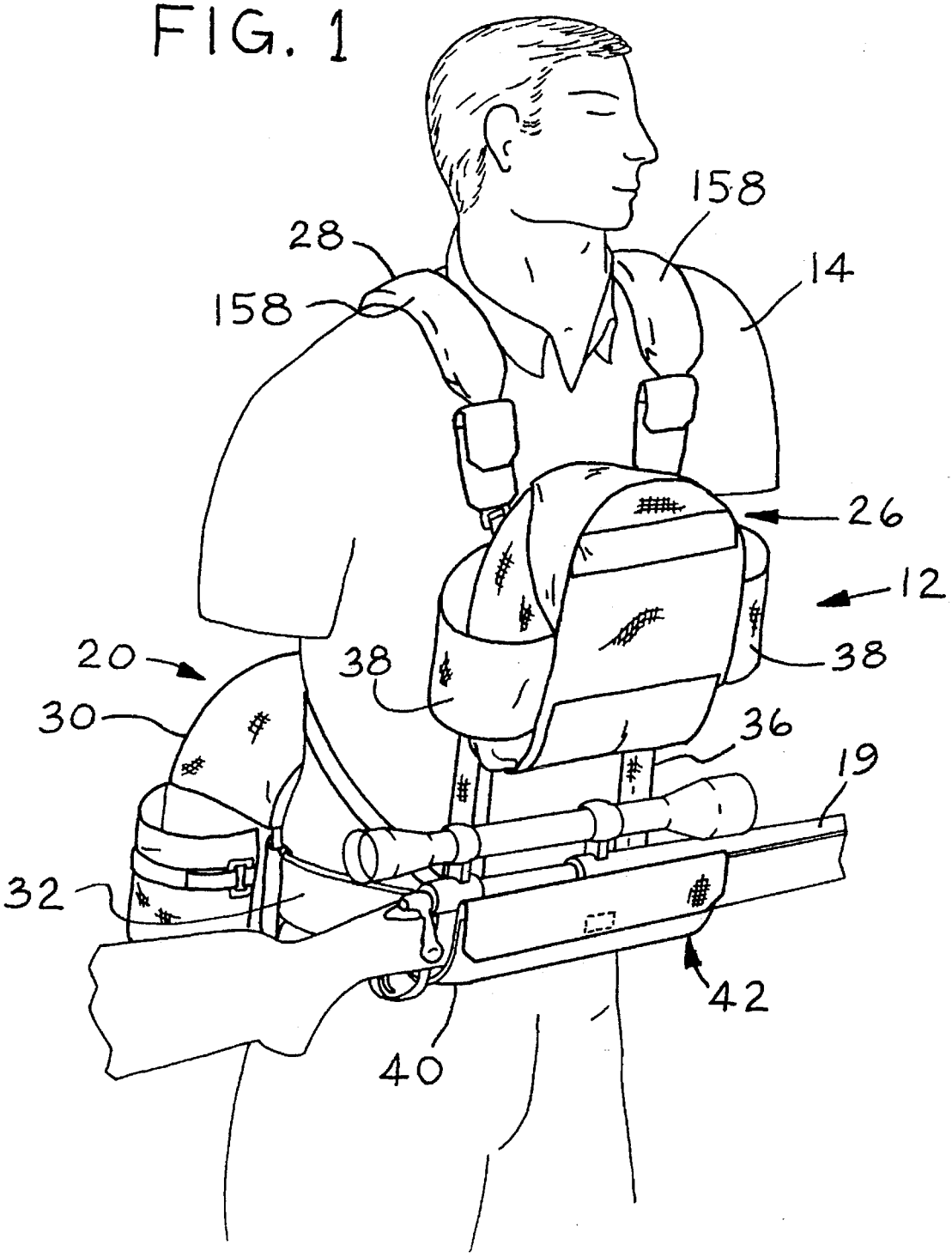
FIG. 1 is a perspective view of a first embodiment of this invention being a front and back pack with gun carrier assembly illustrated as mounted on a person.

The following is a discussion and description of preferred specific embodiments of the multi-purpose front/back pack apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

The multi-purpose front/back pack apparatus 12 of this invention includes four embodiments being 1) a front and back pack with gun carrier assembly 20; 2) a front and back pack with foldable twin pockets 22; 3) a front back pack with foldable twin pockets 23; and 4) a front and back pack with foldable twin pockets with baby carrier 24.

On referring to the drawings in detail, and in particular to FIG. 1, the front and back pack with gun carrier 20 is shown as being utilized by a person 14. The person 14, as shown collectively in various views, has arms 15, a chest 17, a waist portion 21, and being illustrated as conveying an infant 25, milk bottles 16, jars 18 and/or a gun member 19 which will be further described.

The front and back pack with gun carrier assembly 20 includes 1) a front pack assembly 26; 2) a pack and gun carrier frame 40; 3) a gun and cartridge carrier assembly 42 mounted on the pack and gun carrier frame 40; 4) a shoulder strap assembly 28 connected to the front pack assembly 26; 5) a back pack assembly 30; and 6) a support belt member 32 which interconnects the back pack assembly 30 to the front pack assembly 26.

The front pack assembly 26 includes 1) an expandable main pack bag 34; 2) a frame connector housing 36 connected to the expandable main pack bag 34; and 3) bottle carrier members 38 connected to the expandable main pack bag 34.

The expandable main pack bag 34 includes a foldable pack housing 44 having a map storage container 46 connected thereto.

Figure 2:
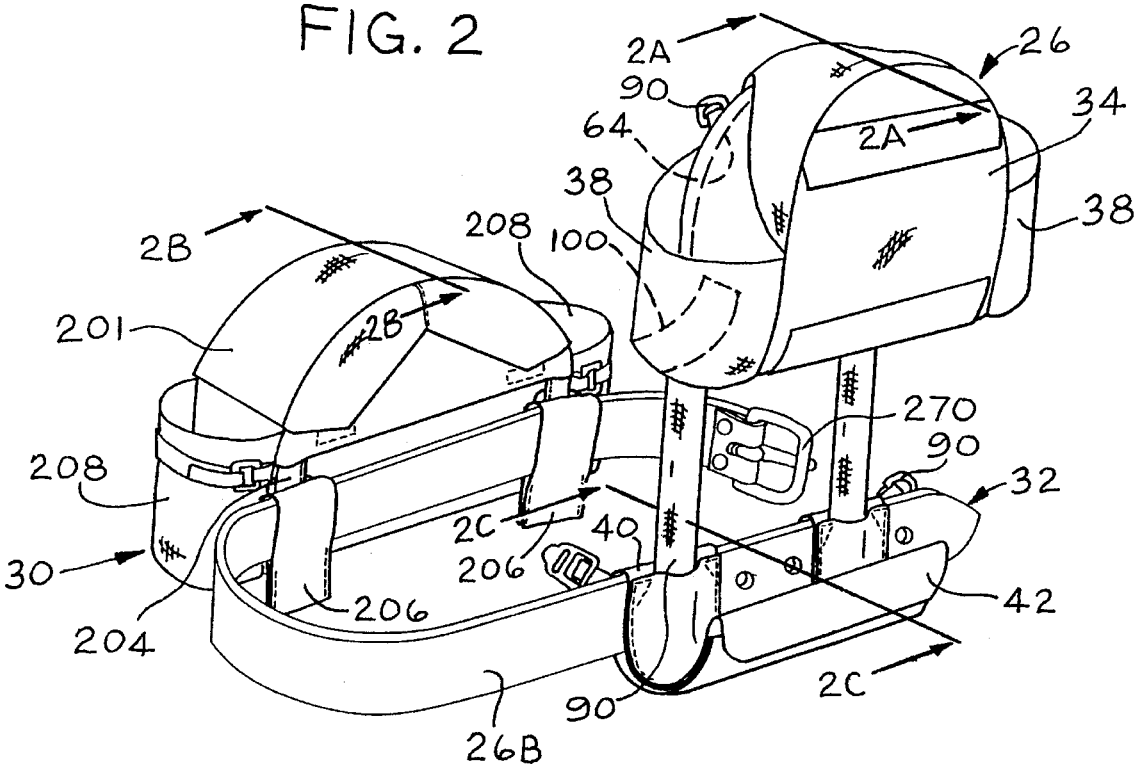
FIG. 2 is a perspective view of the first embodiment.
Figure 2A:
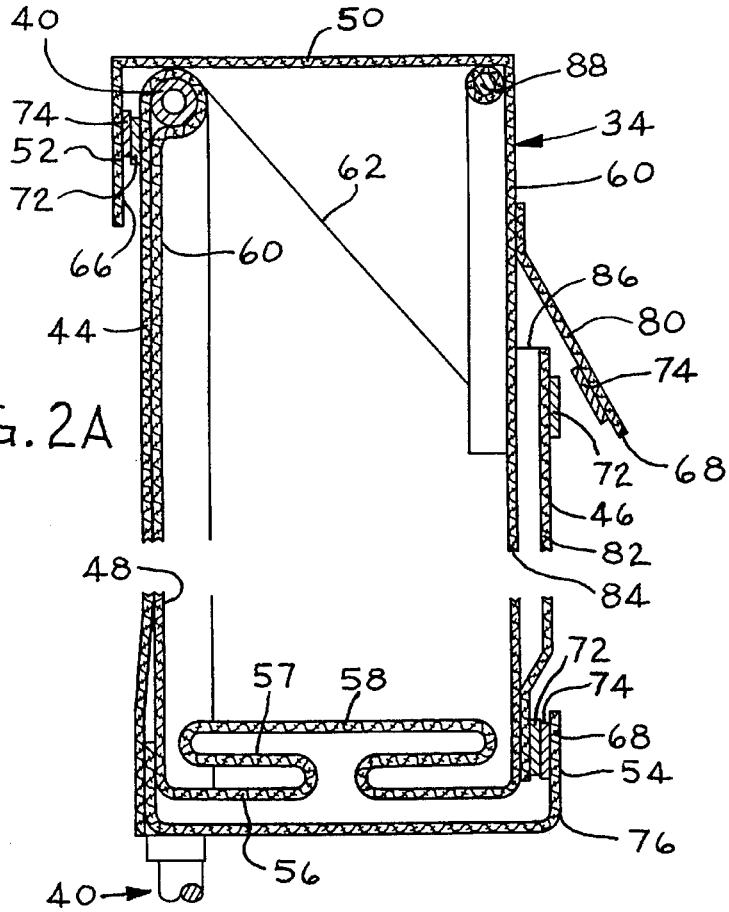
FIG. 2A is an enlarged fragmentary foreshortened sectional view taken along line 2A—2A in FIG. 2.
Figure 9:
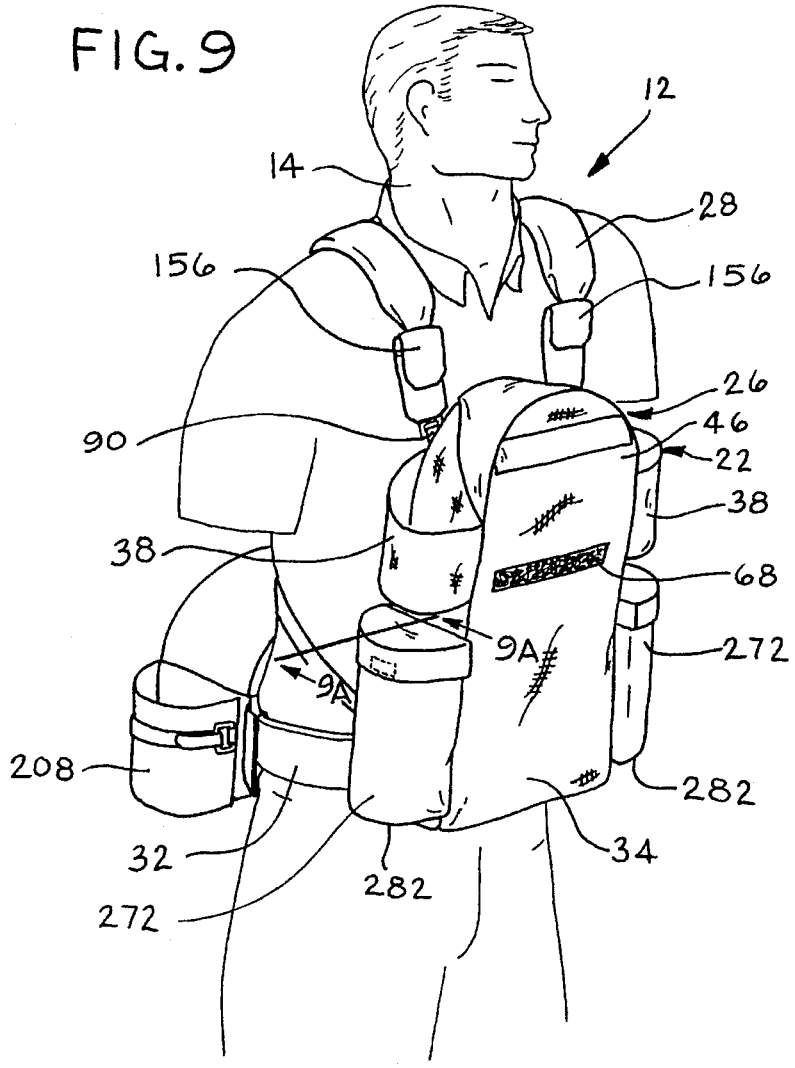
FIG. 9 is a perspective view of a second embodiment being a front and back pack with foldable twin pockets shown as mounted on a person.

The foldable pack housing 44 includes 1) a bottom container housing 48; 2) a top container housing 50 integral with the bottom container housing 48; 3) a bag closure member 52 secured to an upper end of the top container housing 50; 4) a bag retaining flap member 54 operable to hold the bottom container housing 48 in the collapsed position as noted in FIG. 2A and being releasable to allow same to be moved to an expanded position as shown in FIG. 9.

The bottom container housing 48 includes an expandable section 56 having side walls 57 integral with a bottom wall 58.

The top container housing 50 includes 1) top side walls 60 defining an entrance opening 62; 2) a support tubular member 64; and 3) a U-shaped support cord 88 to hold the foldable pack housing 44 in an open position.

As shown in FIG. 2A, the bag closure member 52 includes a closure flap member 66 secured at a forward edge to a forward top side wall 60 and is adapted to overlay the entrance opening 62 to be secured to a rear one of the top side walls 60 by a releasable connector member 68.

The releasable connector member 68 is a conventional Velcro type connector having a hook section 72 releasably connected to a loop section 74.

The bag retaining flap member 54 includes a retaining member 76 secured to a rear one of the side walls 57 of the bottom container housing 48 and connectable to a front side wall 57 by another one of the releasable connector members 68.

The releasable connector member 68 is as previously described having a hook section 72 releasably connectable to a loop section 74.

The map storage container 46 includes a map pocket member 78 being selectively enclosed by a map retaining flap member 80.

The map pocket member 78 includes 1) a front wall 82; 2) a back wall 84; and 3) defining an entrance opening 86.

The map retaining flap member 80 has mounted thereon the releasable connector member 68 having a hook section 72 selectively engagable with the loop section 74.

Each bottle carrier member 38 includes a bottle retainer housing 98 interconnected to opposite sides of the expandable main pack bag 34 and having a vertical support strap 100 connected between the bottle retainer housing 98 and the expandable main pack bag 34.

The vertical support strap 100 is operable in an obvious manner to vertically support any jars 18 or other articles being conveyed therein.

Figure 5:
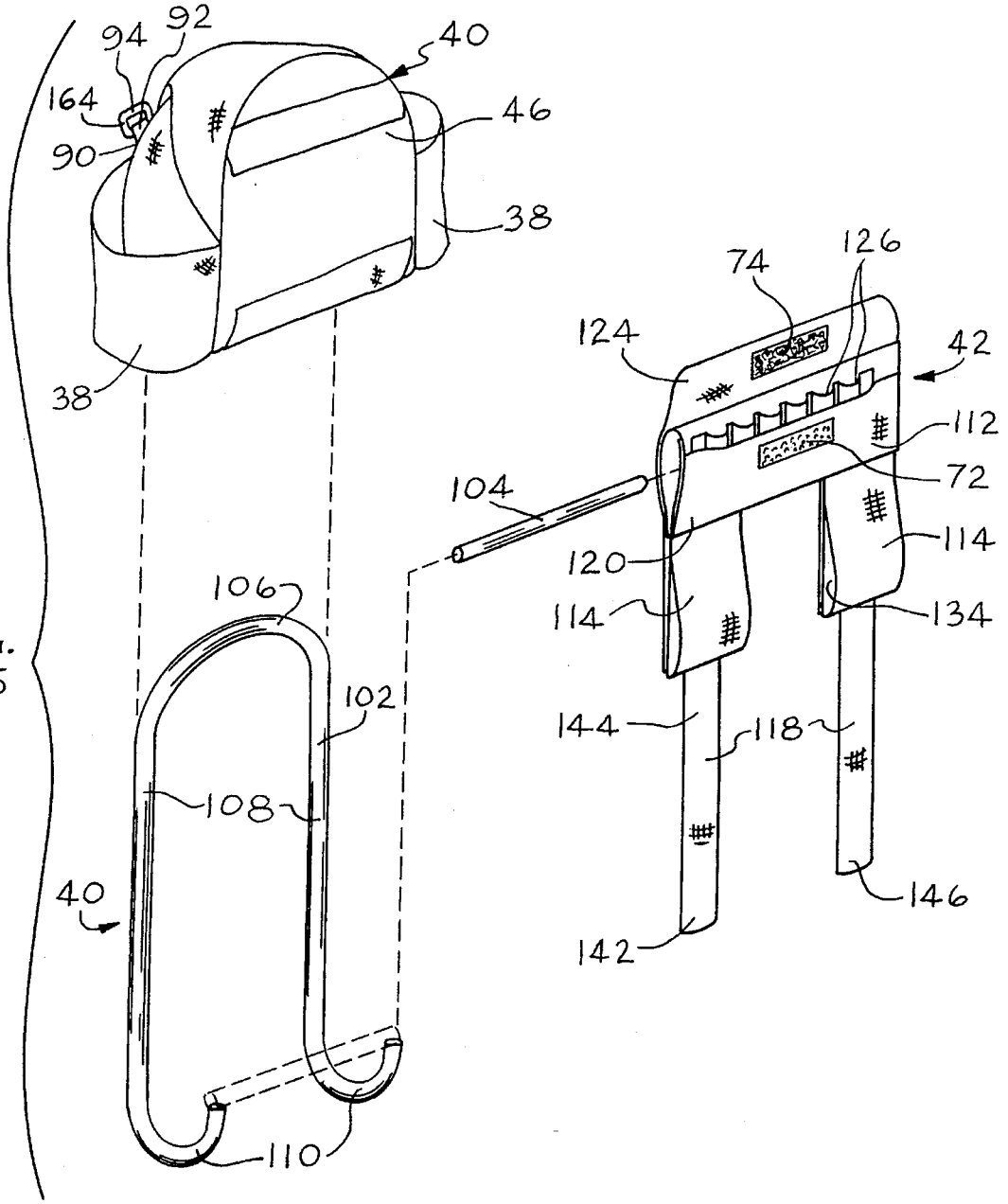
FIG. 5 is an exploded perspective view of the first embodiment having elements removed for clarity.

As noted in FIG. 5, the pack and gun carrier frame 40 includes a main support frame 102 and a lateral support shaft 104.

The main support frame 102 is identical to the support tubular member 64 and includes a top section 106 with opposite ends integral with vertical leg sections 108 which, in turn, are integral with a gun support section 110. In numerous embodiments, the gun support sections 110 are removed.

The combination of the arcuate top section 106 and vertical leg sections 108 are generally of U-shape with the combination of the vertical leg sections 108 and the gun support section 110 being of generally J-shape.

As noted in FIG. 5, the gun and cartridge carrier assembly 42 includes 1) a cartridge carrier assembly 112; 2) belt connector loops 114 connected to the cartridge carrier assembly 112; 3) strap connector members 90 connected to the foldable pack housing 44; and 4) frame cover sleeves 118 connected to the junction of the connection of the belt connector loops 114 with the cartridge carrier assembly 112.

Figure 4:
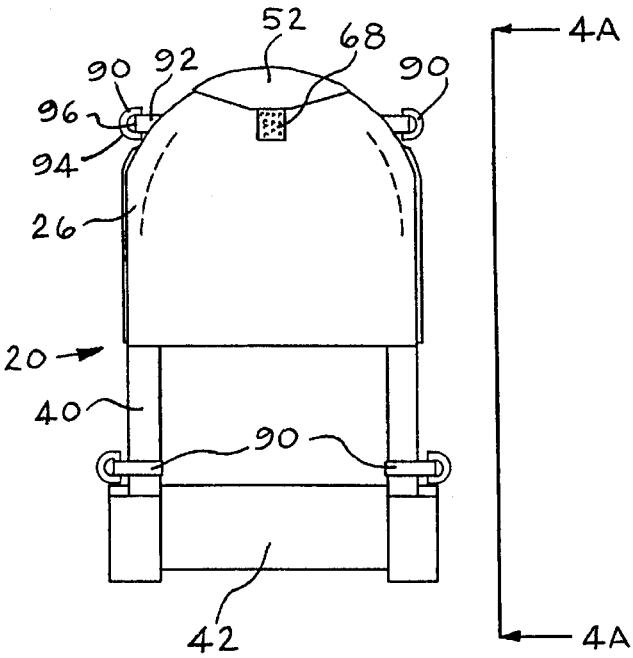
FIG. 4 is an rear elevational view of the first embodiment having portions removed for clarity.
Figure 4A:
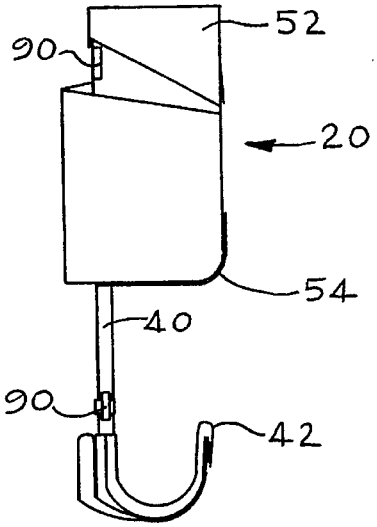
FIG. 4A is a side elevational view taken along line 4A—4A in FIG. 4.

The strap connector members 90 include a support strap 92 having a D-shaped connector lug 94 connected thereto. The connector lug 94 has a strap connector opening 96 (FIG. 4.)

The cartridge carrier assembly 112 includes a main cartridge housing 120 enclosed by a cartridge enclosure flap member 124 and having cartridge receiving loops 126 therein to receive cartridges for use in the gun member 19.

The cartridge enclosure flap member 124 is selectively enclosed and attached by use of the releasable connector member 68 having the hook section 72 releasably engagable with the loop section 74.

The cartridge receiving loops 126 each have a central opening 132 to receive a respective cartridge therein.

The belt connector loops 114 are each provided with a belt receiving opening 134 to receive the support belt member 32 therethrough as will be explained.

Each frame cover sleeve 118 is constructed of an elongated tube member 142 having an upper cartridge carrier connector section 144 and a lower frame receiving section 146.

Figure 3:
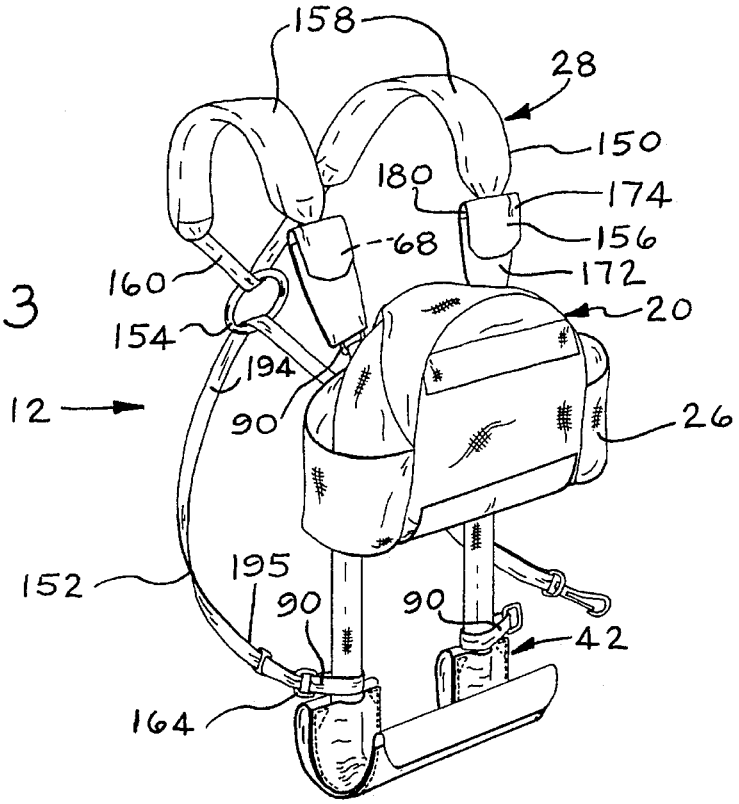
FIG. 3 is a perspective view of the first embodiment having portions removed for clarity.

As best shown in FIG. 3, the shoulder strap assembly 28 includes an upper shoulder strap assembly 150 interconnected by a strap connector ring 154 to a lower support strap assembly 152 which, in turn, is connected by the strap connector members 90 to the gun and cartridge carrier assembly 42.

As shown in FIG. 3, the upper shoulder strap assembly 150 includes the strap connector members 90 connected to a rear, upper portion of the expandable main pack bag 34 and the strap connector members 90 are connected to object retaining pockets 156. In turn, the object retaining pockets 156 are connected to shoulder cushion support members 158 which are interconnected by a ring connector section 160.

The lower support strap member 152 includes a main support strap 192 having an anchor ring section 194 integral on opposite ends with an adjustable end section 195. The adjustable end sections 195 use a buckle member 164 for attachment in a conventional manner to respective strap connector members 90.

The object retaining pockets 156 are used to enclose a pocket knife, flashlight, or the like. Each object retaining pocket 156 includes an object pocket housing 172 selectively enclosed by an object enclosure flap 174.

Figure 10:
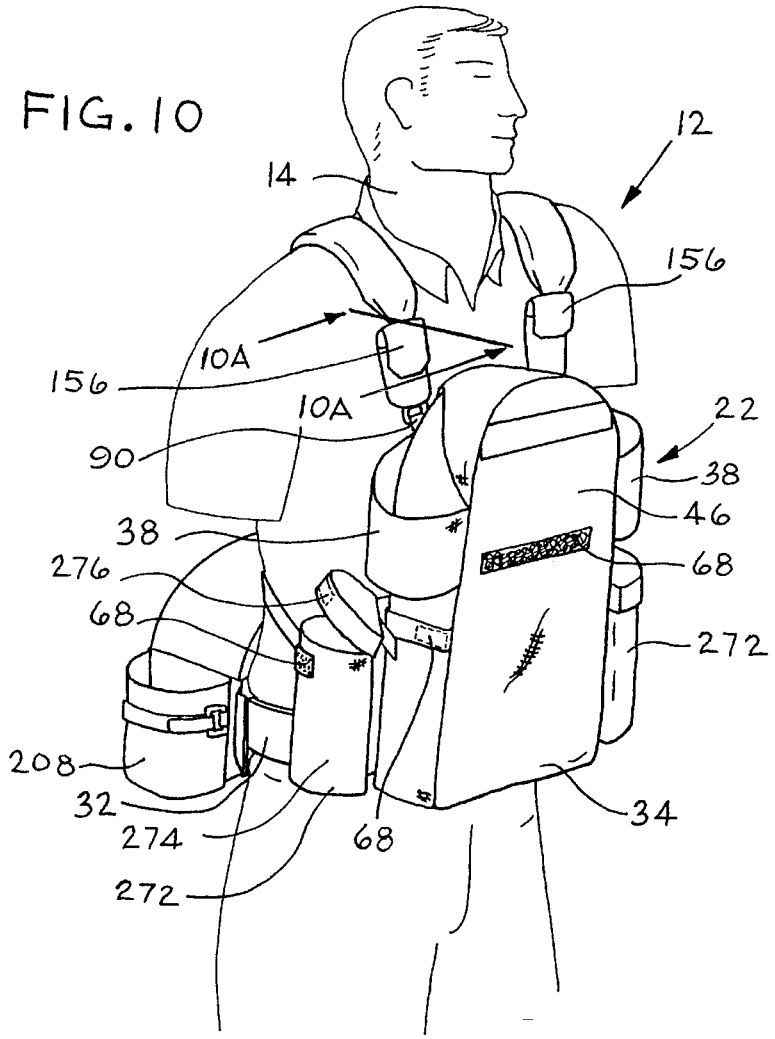
FIG. 10 is a view similar to FIG. 9 illustrating pivotal movement of a foldable twin pocket member.
Figure 10A:
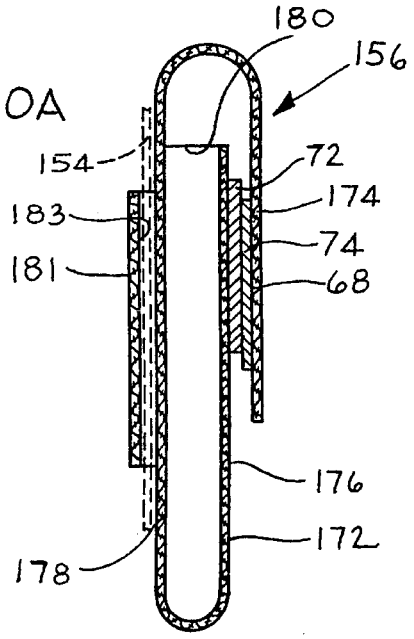
FIG. 10A is an enlarged fragmentary sectional view taken along line 10A—10A in FIG. 10.

As shown in FIG. 10A, the object pocket housing 172 includes an object entrance opening 180 and a strap support member 181. The strap support member 181 has a slot opening 183 to receive a portion of the upper shoulder strap assembly 150 therethrough.

The object enclosure flap 174 is held in the sealed condition of FIG. 10A by one of the releasable connector members 68.

The shoulder strap assembly 28 is adjustable to fit the person 14 by the adjustment features of the strap connector members 90 in conjunction with the adjustable end sections 195 and the buckle members 164 in the lower support strap assembly 152.

As noted in FIG. 2, the back pack assembly 30 includes 1) a back pack bag 201; 2) a back pack support frame and cover 204 to support the back pack bag 201 thereon; 3) belt connector members 206 secured to the back pack support frame and cover 204; and 4) a pair of side container pockets 208 secured to the back pack bag 201.

Figure 2B:
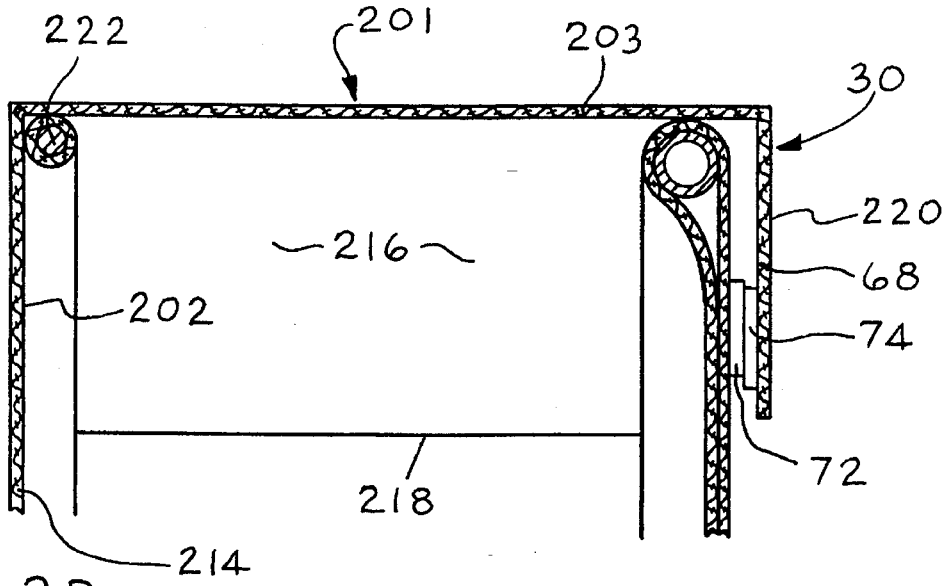
FIG. 2B is an enlarged fragmentary sectional view taken along line 2B—2B in FIG. 2.
Figure 6:
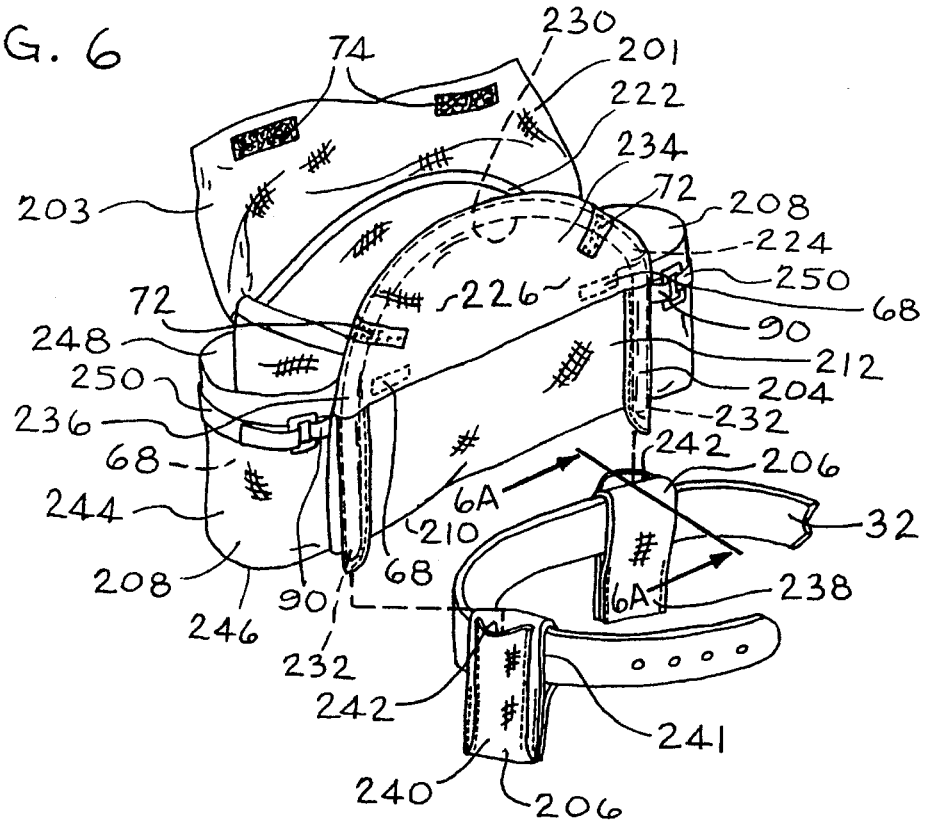
FIG. 6 is a perspective view of a back pack assembly connected to a support belt member shown in exploded perspective.
Figure 6A:
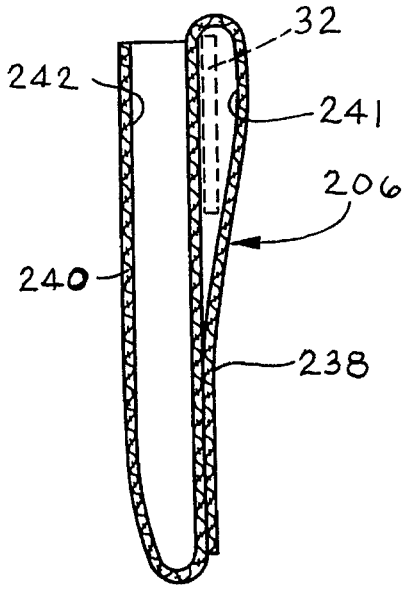
FIG. 6A is an enlarged fragmentary sectional view taken along line 6A—6A in FIG. 6.
Figure 7:
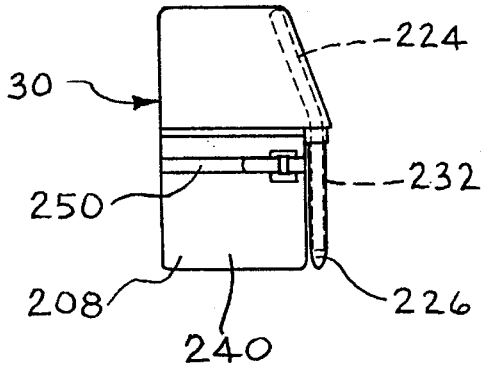
FIG. 7 is a side elevational view of a back pack assembly of the first embodiment.

As shown collectively in FIGS. 2B and 6, the back pack bag 201 includes a main back pack housing 202 having a back pack closure member 203 connected thereto. The main back pack housing 202 includes a bottom wall portion 210 integral with a front wall portion 212; a back wall portion 214; and side wall portions 216 defining an entrance opening 218.

The back pack closure member 203 is secured along one edge to the back wall member 214 having an arcuate support cord 222 therein and is operable to enclose the entrance opening 218 when in the enclosed position of FIG. 2B.

The back pack closure member 203 includes an arcuate connector section 220 provided with the releasable connector member 68 having the hook section 72 releasably connectable to the loop section 74.

As shown in FIG. 6, the back pack support frame and cover 204 includes a support frame member 224 having a support cover member 226 mounted thereon.

The support frame member 224 is of a generally U-shape, preferably constructed of a rigid tubular material, having an arcuate central portion 230 with opposite ends thereof integral with inclined support leg portions 232.

The support cover member 226 is provided with an outer arcuate body section 234 having outer loop portions 236 to receive the opposite ends of the inclined support leg portions 232 mounted therein.

As shown in FIG. 6, the belt connector members 206 are each provided with a front wall section 238 connected to a rear wall section 240 and defining therebetween belt receiving slot openings 241 and frame receiving openings 242.

The frame receiving openings 242 are each respectively operable to receive one of the enclosed inclined support leg portions 232 therein while being conveyed by a person 14 wearing the support belt member 32.

The side container pockets 208 are secured to the main back pack housing 202 as by stitching or the like. Each side container pocket 208 includes a cylinderical side wall 244 integral with a semi-circular bottom wall 246 and defining a pocket entrance opening 248. An adjustable anchor strap 250 surrounds the cylindrical side wall 244.

Each adjustable anchor strap 250 is connectable to itself by a releasable connector member 68 and adjustably connected to a connector member 90.

The support belt member 32 is of a conventional nature having a belt strap section 268 with outer ends thereof releasably interconnectable to a belt buckle member 270.

The second embodiment, as illustrated in FIG. 9, includes the front and back pack with foldable twin pockets 22 having the previously described 1) front pack assembly 26; 2) the shoulder strap assembly 28 connected to the front pack assembly 26; and 3) a back pack assembly 30 interconnected by the support belt member 32 to the front pack assembly 26 and further including foldable or pivotal twin pocket members 272 connected to the front pack assembly 26.

Each pivotal twin pocket member 272 is provided with a pocket housing 274 pivotally connected and secured to the front pack assembly 26 and having an enclosure cap member 276 connected to the pocket housing 274 and held in a given pivoted position by a releasable connector assembly 278.

Each pocket housing 274 is provided with an arcuate side wall 280 having an outer vertical edge secured to the front pack assembly 26 and having a similar circular bottom wall 282 connected to the lower edge of the arcuate side wall 280.

Figure 9A:
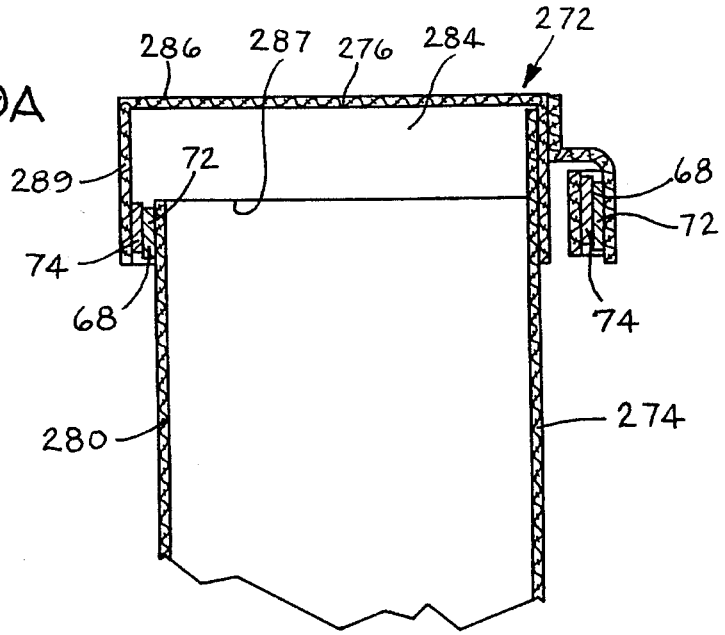
FIG. 9A is an enlarged fragmentary sectional view taken along line 9A—9A in FIG. 9.

As shown in FIG. 9A, each enclosure cap member 276 has an arcuate side wall portion 285 integral with an arcuate front wall 287 and a semi-circular top wall 289. The semi-circular top wall 289 encloses a pocket entrance opening 291.

The arcuate side wall 280 is provided with one of the releasable connector members 68 having a hook section 72 releasably connectable to the loop section 74 as noted in FIG. 9A.

The releasable connector assembly 278 includes a strap member 279 connected a side wall of the expandable main pack bag 34 of the front pack assembly 26 and a connector flap 281 secured to an inner surface of the respective ones of the enclosure cap members 276.

Figure 11:
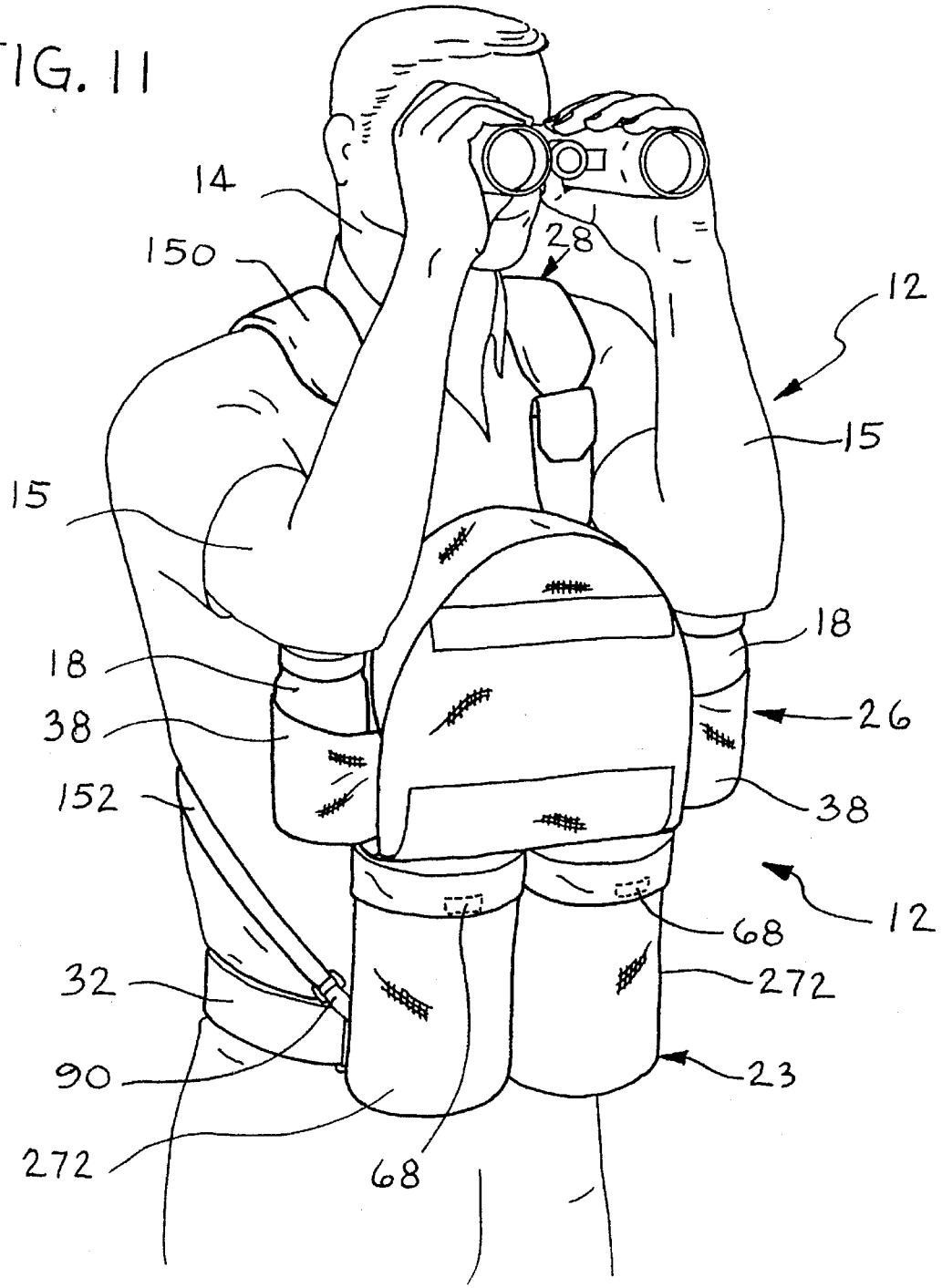
FIG. 11 is a perspective view of the third embodiment being a front back pack with foldable twin pockets illustrating a front pack assembly in a collapsed position and foldable twin pocket members in a folded position and showing use by the person.

In the pivoted position of the foldable twin pocket members 272 as shown in FIG. 11, the connector flaps 281 are releasably connected to the strap member 279 of the expandable main pack bag 34 by one of the releasable connector members 68.

As noted in FIG. 11, the third embodiment is the front back pack with foldable twin pockets 23 having the previous described elements being 1) the front pack assembly 26; 2) the shoulder strap assembly 28; 3) the support belt member 32; and 4) the foldable twin pocket members 272.

The third embodiment is substantially identical to the second embodiment except not utilizing a back pack assembly 30 therewith.

The illustration of FIG. 11 mainly differs from FIG. 10 in having the expandable main pack bag 34 in a collapsed position and the foldable twin pocket members 272 are folded inwardly illustrating that they can be contained under the expandable main pack bag 34 in a compact manner.

Additionally, as noted in FIG. 11, the jars 18 can be placed within the bottle carrier members 38 and an upper surface of the jars 18 is shown as being utilized by the person 14 in order to rest portions of its the arms 15 thereon for support when using a pair of binoculars.

Figure 15:
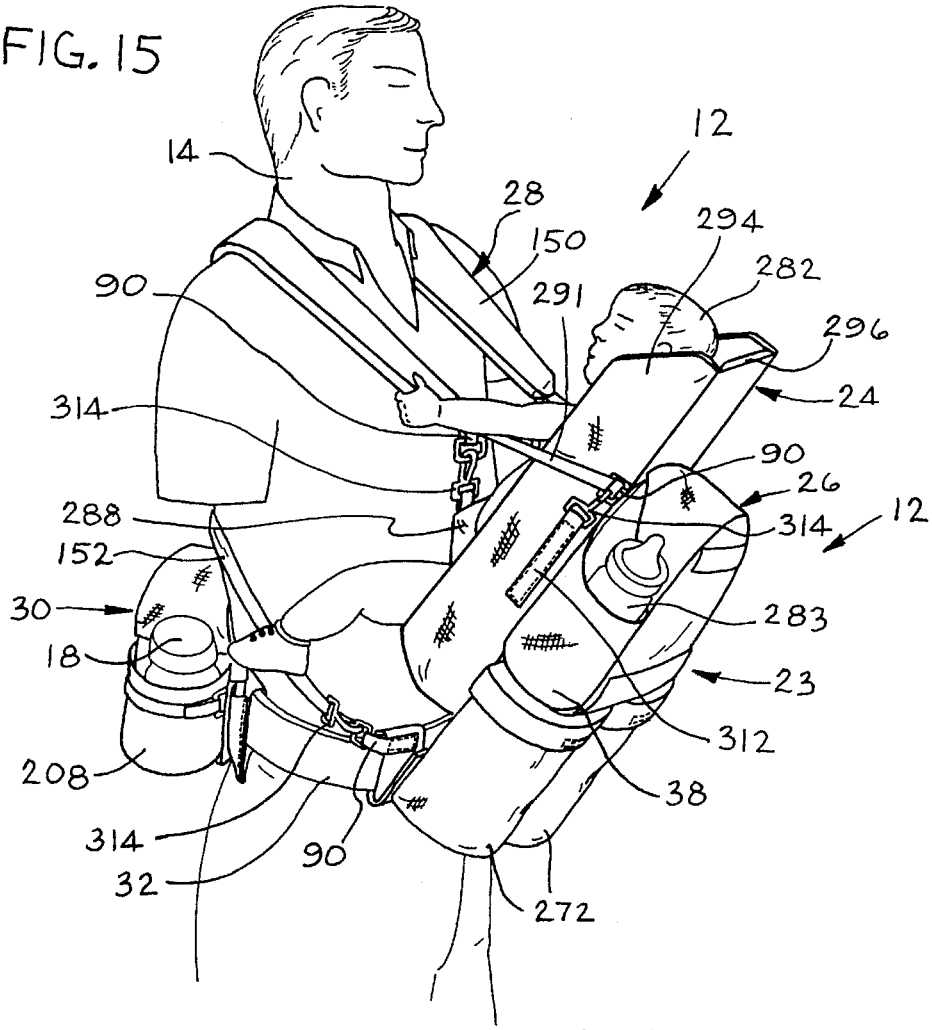
FIG. 15 is a perspective view of a fourth embodiment being the front and back pack with foldable twin pockets and baby carrier illustrating use by the person and having an infant being conveyed thereon.

FIG. 15 shows the fourth embodiment being the front and back pack with foldable twin pockets with baby carrier 24 illustrated as being used by a person 14 operable to carry the infant 25 thereon.

The fourth embodiment includes the front and back with foldable twin pockets 22 with the elements therein as previously discussed for the second embodiment with additional structure for carrying the infant 25 being a baby carrier assembly 284.

The front and back pack with foldable twin pockets with baby carrier 24 in the fourth embodiment includes 1) the front pack assembly 26; 2) the shoulder strap assembly 28; 3) the back pack assembly 30; 4) the support belt member 32; 5) the foldable twin pocket members 272; and 6) the baby carrier assembly 284.

The baby carrier assembly 284 includes a main support member 286 integral with a crotch support member 288 and having connector members 290 secured to the main support member 286 and pack connector straps 291 connected to the main crotch support member 288.

The main support member 286 is provided with a central pad section 292 connected to lateral support pad sections 294 which are foldable inwardly for compact storage.

Figure 16:
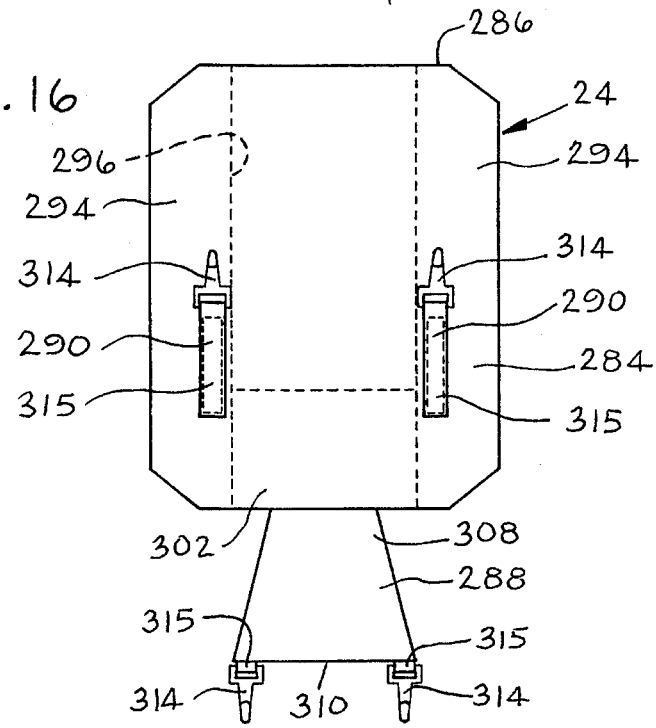
FIG. 16 is a front elevational view of the baby carrier assembly utilized in the fourth embodiment.

As noted in FIG. 16, the central pad section 292 includes 1) a cushion section 296; 2) folding lines 298; and 3) a lower support section 302.

The crotch support member 288 is provided with a support section 308 pivotally connected to the lower support section 302 of the central pad section 292 having an outer edge portion 310 integral with the support section 308.

The connector members 290 are each provided with a connector strap 315 having a snap connector member 314 secured to an outer end thereof.

The outer edge portion 310 is provided with pack connector straps 291 comprised of a connector strap 315 having a snap connector member 314 secured to an outer end thereof. All of the snap connector members 314 are operable to interconnect the main support member 286 of the baby carrier assembly 284 to the shoulder strap assembly 28.

USE AND OPERATION OF THE INVENTION

In the use and operation of the first embodiment, as illustrated in FIGS. 1–8, inclusive, the front and back pack with gun carrier assembly 20 is operable to be adjustably attached to shoulder portions of the person 14 utilizing same.

The lower support strap assembly 152 can be adjustable to receive the right comfortable fit on the person 14. Further, the support belt member 32 is adjustable so as to arrange the back pack assembly 30 in the proper secured position.

It is obvious that a pocket knife, flashlight, or the like can be carried within the object retaining pockets 156.

The front pack assembly 26 can be utilized with the expandable main pack bag 34 to convey and enclose numerous articles therein such as a first aid kit, food, clothing, and the like.

Further, it is noted that the bottle carrier members 38 can be utilized to carry fluid containers therein such as milk bottles 16 or jars 18.

The back pack assembly 30 can be opened and utilized to carry other desired articles therein and be enclosed as noted in FIG. 1. The container pockets 208 can additionally carry any desired articles and then can be secured enclosed for retaining purposes.

As noted in FIG. 1, the gun and cartridge carrier assembly 42 is operable to receive and support the gun member 19 therein for ease of conveyance.

Figure 2C:
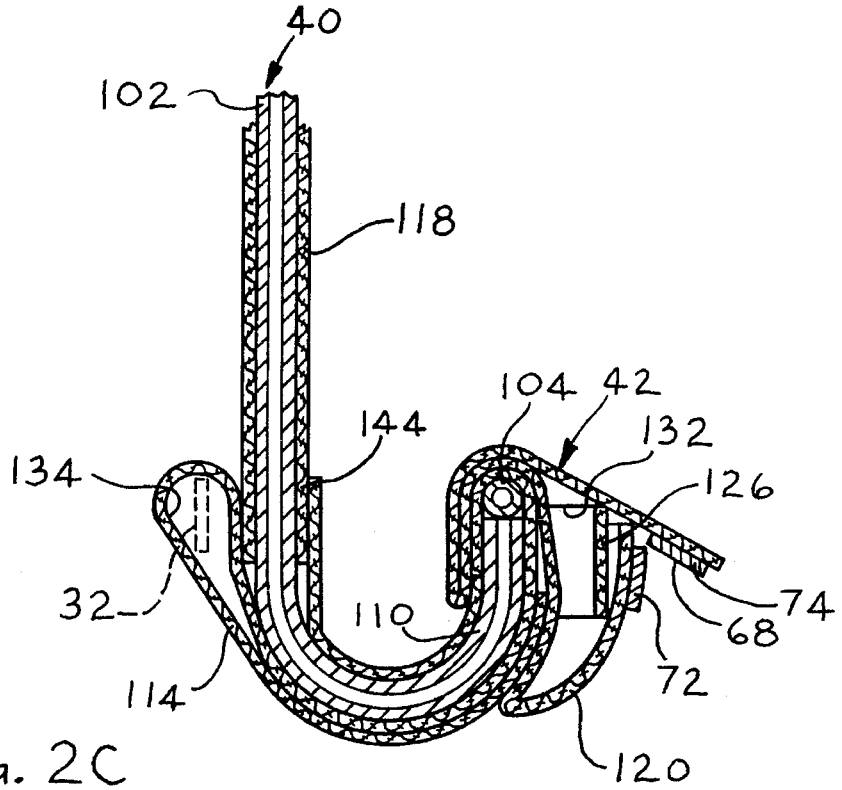
FIG. 2C is an enlarged fragmentary sectional view taken along line 2C—2C in FIG. 2.

As noted in FIG. 2C, the gun and cartridge carrier assembly 42 includes the cartridge receiving loops 126 which can receive cartridges releasably supported therein within the respective cartridge receiving loops 126 being enclosed but readily accessible to the person 14 as needed in a hunting function in order to load the gun member 19.

As noted in FIG. 6, the back pack assembly 30 is releasably connected to the belt connector members 206 which are mounted on the support belt member 32. This allows for the person 14 to remove and not utilize the back pack assembly 30 in certain situations.

Figure 8:
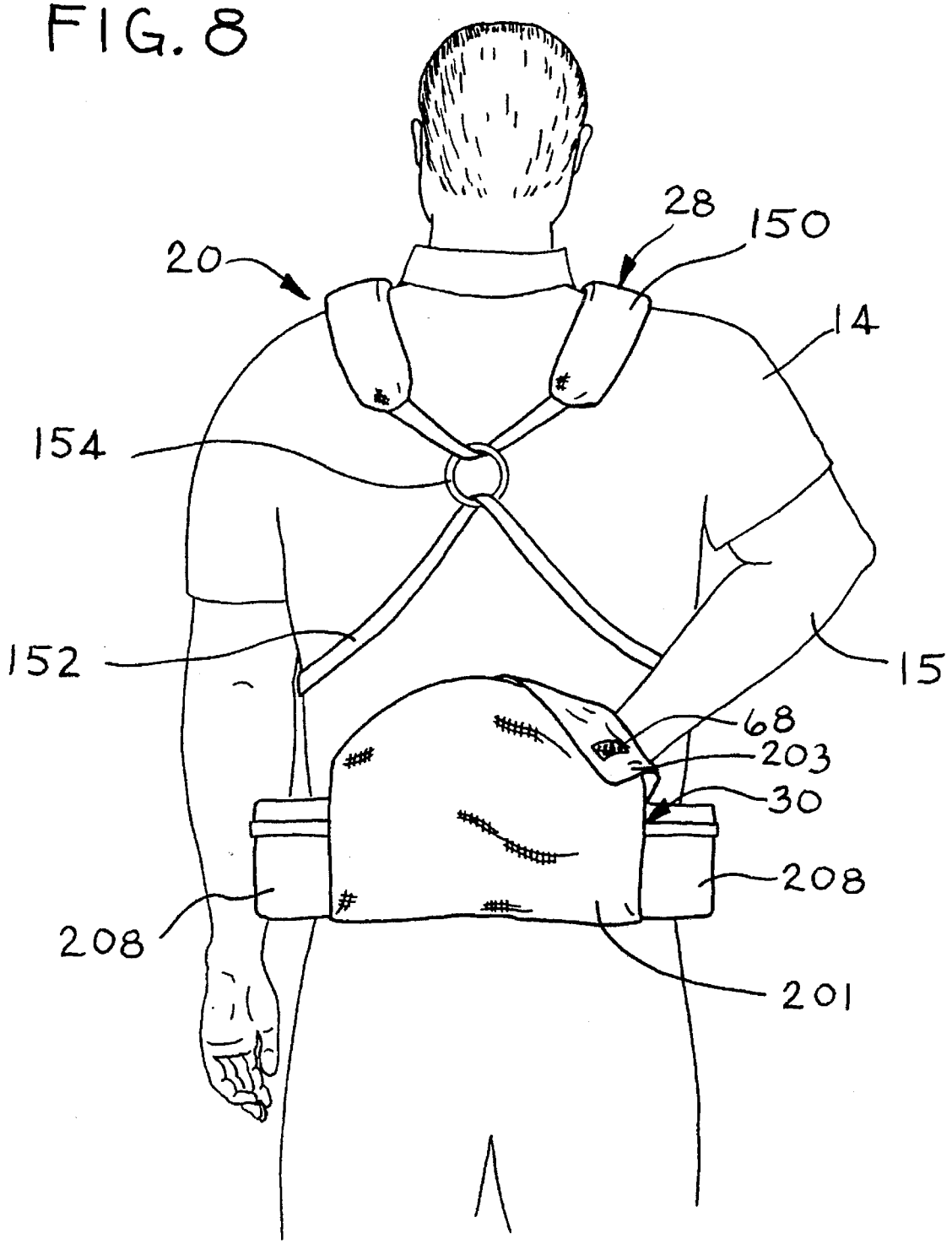
FIG. 8 is a rear elevational view of the first embodiment illustrating access to a back pack member by the person.

As noted in FIG. 8, the person 14 is readily operable, through use of his arm 15, to gain access to the back pack assembly 30 without removing the entire front and back pack with gun carrier assembly 20.

As noted in FIGS. 9–10A, inclusive, the second embodiment of the front and back pack with foldable twin pockets 22 is utilized as described for the first embodiment except is provided with the foldable twin pockets members 272 without the pack and gun carrier frame 40 and the gun and cartridge carrier assembly 42 set forth in the first embodiment.

In FIG. 9, the expandable main pack bag 34 has been opened to its full carrying capacity and having the foldable pocket members 272 each pivoted outwardly and connected to adjacent portions of the expandable main pack bag 34 by the releasable connector member 68. The foldable twin pocket members 272 are operable to maintain articles therein in an enclosed sealed condition.

The pivotal movement and connection of the foldable twin pocket members 272 by the releasable connector members 68 and the releasable connector assemblies 278 is clearly shown in FIG. 10.

In FIGS. 11–14, inclusive, illustrating the third embodiment being the front back pack with foldable twin pockets 23, it is substantially identical to the second embodiment except having the back pack assembly 30 removed therefrom.

FIG. 11 illustrates use of the front back pack with foldable twin pockets 23 having the foldable twin pocket members 272 folded inwardly and the expandable main pack bag 34 is in the enclosed collapsed position.

Figure 12:
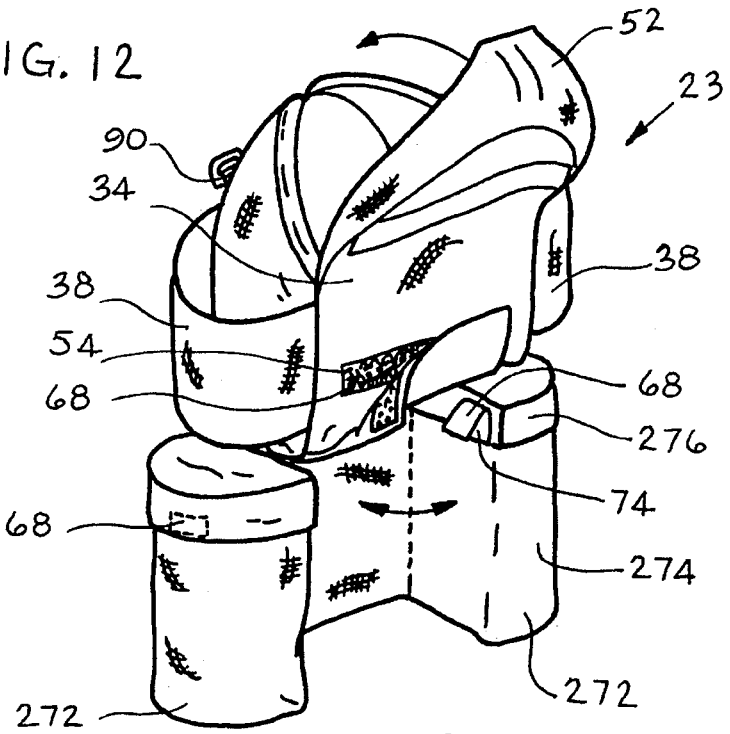
FIG. 12 is a perspective view of a portion of the third embodiment illustrating the front pack assembly and pivotal movement of the foldable twin pocket members.
Figure 13:
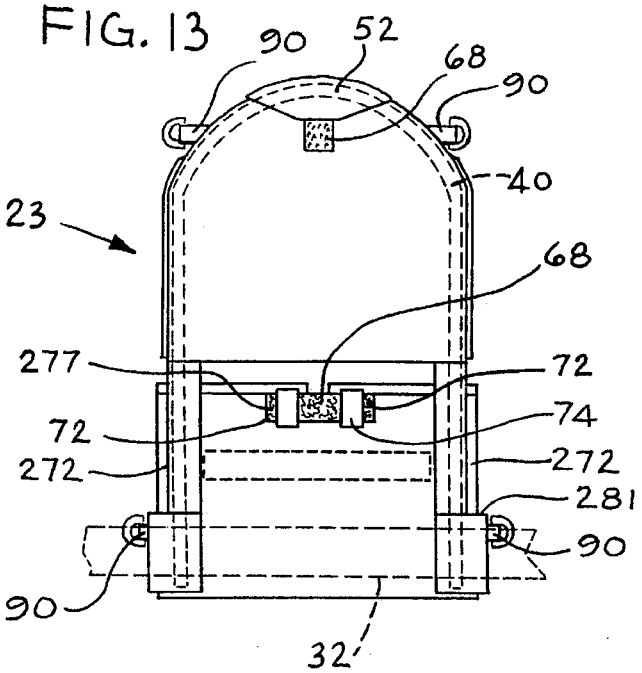
FIG. 13 is a rear elevational view of the third embodiment with portions removed for clarity.
Figure 14:
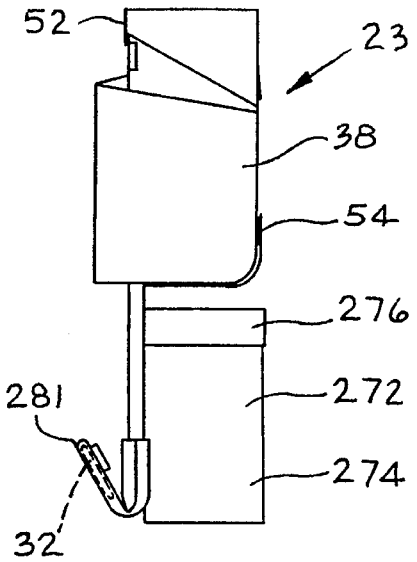
FIG. 14 is a side elevational view of the view shown in FIG. 13.

FIG. 12 illustrates the pivotal movement of the foldable twin pockets members 272 and movement of the bag closure member 52 from an open to the closed position as noted by an arrow 315.

On referring to the fourth embodiment being the front and back pack with foldable twin pockets and baby carrier 24, it is noted that it is identical to the third embodiment except having the baby carrier assembly 284 with the infant 25 mounted therein.

On use of the baby carrier assembly 284 as shown in FIG. 15, the infant 25 is placed within the main support member 286 and the crotch support member 288 and the connector members 290 are connected on each side to the shoulder strap assembly 28.

Further, the crotch support member 288 is interconnected through the pack connector straps 291 and the snap members 314 at the outer edge portion 310 to the strap connector members 90 on the shoulder strap assembly 28.

The baby carrier assembly 284 provides an easy manner of carrying the infant 25 therein providing an ideal weight balance situation plus the person 14 has the infant 25 forwardly so as to be easily observable at all times. It is noted that baby bottles 16 can be readily carried as noted in FIG. 15.

The multi-purpose front/back pack apparatus 12 with its numerous embodiments presents a structure that is readily mountable on a person; providing a shoulder strap assembly that provides comfort and balance to the person utilizing same; providing front and back pack assemblies for maximum conveyance capacity: providing a gun and cartridge carrier assembly operable to support and convey cartridges and a gun member thereon; providing a releasable baby carrier assembly operable to convey an infant therein in a readily observable position; providing advantages of weight balance for ease of conveyance of the infant; sturdy in construction; and substantially maintenance free.

While the invention has been described in conjunction with preferred specific embodiments thereof, it will be understood that this description is intended to illustrate and not to limit the scope of the invention, which is defined by the following claims:

I claim:

1. A multi-purpose pack apparatus adapted to be supported on a person, comprising:

a) a front back pack having a pivotal pocket member connected thereto;

b) connector means releasably and adjustably connected to said front back pack, and said connector means operable to be supported about a shoulder portion of the person;

c) said front back pack includes an expandable main pack bag selectively foldable from a collapsed position with a minimum distance from a bag closure member to a bottom wall of a bottom container housing of said main pack bag to an expanded position with a maximum distance from said bag closure member to said bottom wall of said main pack bag to selectively increase carrying capacity thereof; and d) said pivotal pocket member movable from a first position under said expandable main pack bag when in the collapsed position to a second position laterally of said expandable main pack bag when in the expanded position in an area previously occupied by said pivotal pocket member.

2. A multi-purpose pack apparatus as described in claim 1, wherein:

a) said connector means includes a shoulder strap assembly having an upper strap assembly provided with an object retaining pocket connected thereto; and b) said object retaining pocket includes an object pocket housing selectively enclosed by an object enclosure flap operable to support an article in said object pocket housing.

3. A multi-purpose pack apparatus as described in claim 1, including:

a) a back pack bag connected by a connector member to the front back pack and operable to be worn about a waist area of the person utilizing same;

b) said back pack bag includes a main back pack housing selectively enclosed by an interconnected back pack closure member; and c) said back pack bag connected to a back pack support frame and cover and a support connector member secured to said back pack support frame and cover and operable to be releasably connected to said connector member.

4. A multi-purpose pack apparatus as described in claim 3, wherein:

a) said back pack assembly includes a pair of side container pockets connected to said back pack bag; and b) said side container pockets having an area to receive and support an article therein and an adjustable anchor strap connected thereto which is operable to collapse said side container pocket about the article being contained therein to prevent dislodging thereof.

5. A multi-purpose pack apparatus as described in claim 1, wherein:

a) said front back pack having a pair of said pivotal pocket members connected thereto; and b) each of said pivotal pocket members having a pocket housing with an enclosure cap member connected thereto by a releasable connector assembly.

6. A multi-purpose pack apparatus as described in claim 1, wherein:

a) said front pack assembly includes carrier members connected thereto operable to convey an article therein.

7. A multi-purpose pack apparatus adapted to be supported on a person, comprising:

a) a front back pack having a pivotal pocket member connected thereto;

b) connector means releasably and adjustably connected to said front back pack, and said connector means operable to be supported about a shoulder portion of the person;

c) said front back pack includes an expandable main pack bag selectively movable from a collapsed position to an expanded position to selectively increase carrying capacity thereof;

d) said pivotal pocket member movable from a first position under said expandable main pack bag when in the collapsed position to a second position laterally of said expandable main pack bag when in the expanded position;

e) said front back pack having a pair of said pivotal pocket members connected thereto; and f) each of said pivotal pocket members having a pocket housing with an enclosure cap member connected thereto by a releasable connector assembly;

whereby said enclosure cap member is movable from one position enclosing said pocket housing assembly to a second open position to allow access in placing or removing articles in said pocket housing.

8. A multi-purpose pack apparatus as described in claim 7, wherein:

a) said pivotal pocket members are pivotally connected at one point to said front pack assembly and pivotal from an enclosed position under said front pack assembly to a pivoted position extended laterally of said front pack assembly allowing said expandable main pack bag to be moved to the second expanded position for maximum carrying capacity.

9. A multi-purpose pack apparatus as described in claim 8, wherein:

a) said front pack assembly includes carrier members connected thereto operable to convey an article therein.

10. A multi-purpose pack apparatus adapted to be conveyed and supported on a person, comprising:

a) a front pack assembly including an expandable main pack bag.

b) connector means releasably and adjustably connected to said front pack assembly operable to be mounted about a shoulder portion of a person;

c) a back pack assembly including a back pack bag operable to be conveyed against a lower back portion of the person;

d) a connector member connected to said front pack assembly and said back pack assembly and operable to be mounted about a waist portion of the person;

e) said main pack bag is selectively movable from a first folded collapsed, reduced capacity position to a second downwardly, unfolded expanded maximum capacity position to achieve maximum carrying capacity;

f) said main pack bag includes an expandable section having a foldable bottom wall selectively movable from said reduced capacity position to said maximum capacity position;

g) a pair of foldable pocket members secured to said front pack assembly;

h) each of said pocket members having a pocket housing and an enclosure cap member secured to said pocket housing operable to be moved from an enclosed position to an open position for removing and placing articles within said pocket housing; and i) said foldable pocket members are pivotally connected at respective points to said front pack assembly and pivotal from an enclosed position under said front pack assembly to a pivoted position extended laterally of said front pack assembly allowing said expandable main pack bag to be moved to the second expanded position for maximum carrying capacity.

11. A multi-purpose pack apparatus as described in claim 10, wherein:

a) said front pack assembly includes carrier members connected thereto operable to receive, support, and convey an article therein.

12. A multi-purpose pack apparatus adapted to be conveyed and supported on a person, comprising:

a) a front pack assembly including an expandable main pack bag;

b) connector means releasably and adjustably connected to said front pack assembly operable to be mounted about a shoulder portion of a person;

c) a back pack assembly including a back pack operable to be conveyed against a lower back portion of the person;

d) a connector member connected to said front pack assembly and said back pack assembly and operable to be mounted about a waist portion of the person;

e) said main pack bag is selectively movable from a first collapsed position to a second expanded position to achieve maximum carrying capacity; and f) a baby carrier assembly releasably connected to said connector means and supported against said front pack assembly operable to support and convey an infant therein.

13. A multi-purpose pack apparatus as described in claim 12, wherein:

a) said baby carrier assembly includes a main support member having a central pad section with integral, lateral pad sections; and b) said baby carrier assembly includes connector members releasably connecting said main support member to said connector means.

14. A multi-purpose pack apparatus as described in claim 12, wherein:

a) said baby carrier assembly includes a main support member having a central pad section connected to integral laterally extended pivotal support pad sections;

whereby said main support member has said lateral support pad sections folded inwardly against said central pad section to present a collapsed condition for ease of conveyance and storage.

15. A multi-purpose pack apparatus as described in claim 12, wherein:

a) said baby carrier assembly includes a main support member having a crotch support member connected thereto and a plurality of connector members secured to said main support member and said crotch support member for releasable connection to said connector means.

16. A multi-purpose pack apparatus adapted to be conveyed and supported on a person, comprising:

a) a front pack assembly including an expandable main pack bag;

b) connector means releasably and adjustably connected to said front pack assembly operable to be mounted about a shoulder portion of a person;

c) a back pack assembly including a back pack bag operable to be conveyed against a lower back portion of the person;

d) a connector member connected to said front pack assembly and said back pack assembly and operable to be mounted about a waist portion of the person;

e) said main pack bag is selectively movable from a first collapsed position to a second expanded position to achieve maximum carrying capacity; and f) pocket members pivotally secured to said front pack assembly, and said pocket members movable from a stored position under said front pack assembly to a position laterally of said expandable main pack bag when expanded to the position of maximum carrying capacity and being releasably connected to said front pack assembly in said stored position.

17. A multi-purpose pack apparatus to be supported on a person, comprising:

a) a front back pack including an expandable selective capacity main pack bag including a foldable pack housing with an expandable section having a foldable bottom wall selectively foldable from a collapsed reduced capacity position with a distance from a bag closure member to said bottom wall of a bottom container housing of said main pack bag being minimum to an expanded maximum capacity position with said bag closure member a maximum distance from said bottom wall container housing to selectively increase carrying capacity thereof;

b) said expandable selective capacity main pack bag includes a bag retaining member operable in one position to positively hold said foldable pack housing in the reduced capacity collapsed position and movable to a second position to allow said foldable pack housing to move to the expanded maximum capacity position;

c) said front back pack includes a pivotal pocket member connected thereto; and d) said pivotal pocket member movable from a first position under said foldable pack housing when said foldable pack housing is in the collapsed position to a second position adjacent to and laterally of said foldable pack housing when said foldable pack housing is in the expanded unfolded position in an area previously occupied by said pivotal pocket member.

whereby said front back pack is readily accessible to a person during a hiking operation without removal from said person.

18. A multi-purpose pack apparatus as described in claim 17, including:

a) said front back pack includes a second pivotal pocket member connected thereto; and b) each of said pivotal pocket members movable from a first position under said foldable pack housing when in the collapsed folded position to a second position laterally of said foldable pack housing when in the expanded unfolded position in an area previously occupied by said pivotal pocket members.

19. A multi-purpose pack apparatus as described in claim 17, including:

a) said front pack assembly includes a carrier member connected thereto operable to convey an article therein.

20. A multi-purpose pack apparatus as described in claim 17, including:

a) connector means connected to said front back pack and operable to be mounted about a shoulder portion of a person; and b) a baby carrier assembly releasably connected to said connector means and supported against said front back pack operable to support and convey an infant therein.

21. A multi-purpose pack apparatus as described in claim 20, wherein:

a) said baby carrier assembly includes a main support member having a central pad section with integral, lateral pad sections; and b) said baby carrier assembly includes connector members releasably connecting said main support member to said connector means.

22. A multi-purpose pack apparatus as described in claim 20, wherein:

a) said baby carrier assembly includes a main support member having a crotch support member connected thereto and a plurality of connector members secured to said main support member and said crotch support member for releasable connection to said connector means.

* * * * *